US011207704B2

(12) United States Patent
Foury et al.

(10) Patent No.: US 11,207,704 B2
(45) Date of Patent: Dec. 28, 2021

(54) INSTALLATION FOR SPRAYING A FLUID AND RELATED METHODS

(71) Applicant: EXEL INDUSTRIES, Épernay (FR)

(72) Inventors: Philippe Foury, Paris (FR); David Vincent, Paris (FR); Cyrille Medard, Paris (FR)

(73) Assignee: EXEL INDUSTRIES, Epernay (FR)

( * ) Notice: Subject to any disclaimer, the term of this patent is extended or adjusted under 35 U.S.C. 154(b) by 0 days.

(21) Appl. No.: 16/656,368

(22) Filed: Oct. 17, 2019

(65) Prior Publication Data

US 2020/0122177 A1 Apr. 23, 2020

(30) Foreign Application Priority Data

Oct. 19, 2018 (FR) ..... 1859673

(51) Int. Cl.
*B05B 12/14* (2006.01)
*B05B 15/55* (2018.01)
*B05B 5/16* (2006.01)

(52) U.S. Cl.
CPC ..... *B05B 12/149* (2013.01); *B05B 5/1675* (2013.01); *B05B 15/55* (2018.02)

(58) Field of Classification Search
None
See application file for complete search history.

(56) References Cited

U.S. PATENT DOCUMENTS

| | | | | |
|---|---|---|---|---|
| 1,746,228 A * | 2/1930 | Darling | B05B 14/465 118/302 |
| 5,389,149 A * | 2/1995 | Carey | B05B 12/122 118/302 |
| 2008/0107796 A1* | 5/2008 | Cho | B05C 11/1013 427/8 |

FOREIGN PATENT DOCUMENTS

| | | | |
|---|---|---|---|
| DE | 102008015258 | A1 | 9/2009 |
| EP | 1172152 | A1 | 1/2002 |
| EP | 3069796 | A1 | 9/2016 |
| WO | 2003095308 | A1 | 11/2003 |

OTHER PUBLICATIONS

Patent Translate for Patent Publication No. DE 102008015258, Sep. 17, 2019, 30 pp.
Patent Translate for Patent Application No. EP1172152, Sep. 17, 2019, 10 pp.
INPI Rapport de Recherche Préliminaire for Patent Application No. FR1859673, Aug. 1, 2019, 2 pp.

* cited by examiner

*Primary Examiner* — Jethro M. Pence
(74) *Attorney, Agent, or Firm* — Soquel Group LLC

(57) ABSTRACT

An installation for spraying a fluid comprising a fluid circulation circuit including a sprayer capable of spraying the fluid, a pump and a circulation pipe for the fluid, the pump being suitable for injecting the fluid into the circulation pipe, the circulation pipe being configured to guide the fluid from the pump to the sprayer, the installation further including at least one injector configured to inject a liquid separate from the fluid into the circuit, wherein the injector is configured to compare a total volume of liquid injected into the circuit to a predetermined volume, and to stop the injection when the total volume of injected liquid is equal to the predetermined volume.

8 Claims, 5 Drawing Sheets

INSTALLATION FOR SPRAYING A FLUID AND RELATED METHODS

CROSS-REFERENCE TO RELATED APPLICATION

This application claims priority of French Patent Application No. 18 59673, filed on Oct. 19, 2018.

FIELD OF THE INVENTION

The present invention relates to an installation for spraying a fluid. The present invention also relates to a method implemented by such an installation.

BACKGROUND OF THE INVENTION

Fluid spraying installations are used in many applications, in particular, to spray paints or other coating products. In these installations, the fluid to be sprayed circulates in a pipe from a pumping device, in particular, comprising a color-changing unit to another spraying device such as a sprayer.

The operation of these installations frequently requires the use of a solvent capable of dissolving or diluting the sprayed fluid. Thus, during the replacement of one fluid with another, for example during the passage from one color to another, it is necessary to clean the pipe in which the fluids circulate in order to avoid any contamination of the fluid to be sprayed by the fluid previously sprayed.

In some cases, the fluid present in the pipe is propelled to the sprayer by injecting a cleaning liquid such as a solvent into the pipe. However, part of the fluid then remains on the inner walls of the pipe, the cleaning liquid then progressing in the radially central part of the pipe, surrounded by the fluid remaining on the walls. As a result, only part of the fluid present in the pipe is actually sprayed.

In some installations, a scraper is used to clean the pipe and for example to bring the fluid back into the pumping device so that it can be reused. However, this involves a substantial loss of time between two spraying operations, since the scraper must be introduced into the pipe, push the fluid back to the pumping device, then return to the point where the scraper was introduced in order to be removed from the pipe.

In other cases, the cleaning liquid injected into the pipe circulates up to the sprayer in order to clean the sprayer, in particular, in order to clean the rotary bowl that equips many types of sprayers.

However, the cleaning of such installations requires large quantities of solvent. In particular, the cleaning liquid is injected at one end of the pipe through a pressure-regulated pump (sometimes called "circulating pump"), the cleaning liquid flow rate therefore depending on the capacity of the cleaning liquid to circulate up to the end of the pipe and head losses that occur during this circulation. It is therefore difficult to achieve precise control of the quantity of cleaning liquid used, which causes the use of a larger quantity than what is required in order to ensure that a sufficient quantity of cleaning liquid is indeed used.

SUMMARY OF THE INVENTION

The aim of the invention is to provide a fluid spraying installation that is more cost-effective in terms of quantity of cleaning liquid used.

To that end, the invention relates to an installation for spraying a fluid comprising a fluid circulation circuit including a sprayer capable of spraying the fluid, a pump and a circulation pipe for the fluid, the pump being suitable for injecting the fluid into the circulation pipe, the circulation pipe being configured to guide the fluid from the pump to the sprayer, the installation further comprising at least one injector configured to inject a liquid separate from the fluid into the circuit. The injector is configured to:

- compare a total volume of liquid injected into the circuit to a predetermined volume, and
- stop the injection when the total volume of injected liquid is equal to the predetermined volume.

According to advantageous, but optional aspects of the invention, the installation includes one or more of the following features, considered alone or in any technically possible combination:

- the injector comprises a cylinder capable of containing the liquid, a piston received in the cylinder and an actuator capable of moving the piston in the cylinder from a first position to a second position, the injector being configured so that the movement of the piston in the cylinder to its second position causes the injection of the liquid in the circulation pipe.
- the injector is capable of determining a position of the piston in the cylinder and estimating the volume of liquid injected from at least the determined position.
- a volume flow rate is defined for the liquid injected by the injector into the circuit, the injector being configured to determine at least one value of the volume flow rate and to estimate the injected volume from the measured flow rate value(s).
- the injector is further configured to inject, into the circuit, a gas capable of propelling the liquid, the injector being configured to inject the liquid with a first pressure and to inject the gas with a second pressure, the first pressure being greater than or equal to the second pressure.
- the installation comprises a pressure sensor capable of measuring the first pressure.
- the actuator comprises an electric motor, the actuator being capable of estimating the first pressure from at least one value of an electric current consumed by the electric motor.
- an upstream direction and downstream direction are defined for the circulation pipe, the fluid circulating from upstream to downstream when the fluid is guided by the circulation pipe from the pump to the sprayer, the injector being configured to inject the liquid in an upstream end of the circulation pipe.
- the circuit comprises a color-changing unit capable of supplying the pump with a plurality of distinct fluids, in which:
  - the injector is configured to inject the liquid into the color-changing unit, and/or
  - the injector is configured to inject the liquid into the pump, and/or
  - the injector is configured to inject the liquid into the sprayer, the sprayer in particular comprising a rotary bowl and being capable of guiding the liquid to the rotary bowl.

The invention also relates to a method implemented by an installation for spraying a fluid comprising a fluid circulation circuit including a sprayer capable of spraying the fluid, a pump and a circulation pipe for the fluid, the pump being suitable for injecting the fluid into the circulation pipe, the circulation pipe being configured to guide the fluid from the pump to the sprayer, the installation further comprising at least one injector, the method comprising a step for the injection, by the injector, of a liquid separate from the fluid into the circuit. The injection step comprises:

the comparison of a volume of liquid injected into the circuit from the beginning of the injection step to a predetermined volume, and stopping the injection when the total volume of injected liquid is equal to the predetermined volume.

BRIEF DESCRIPTION OF THE DRAWINGS

Features and advantages of the invention will appear more clearly upon reading the following description, provided solely as a non-limiting example, and done in reference to the appended drawings, in which.

DETAILED DESCRIPTION OF THE INVENTION

Figure 1:
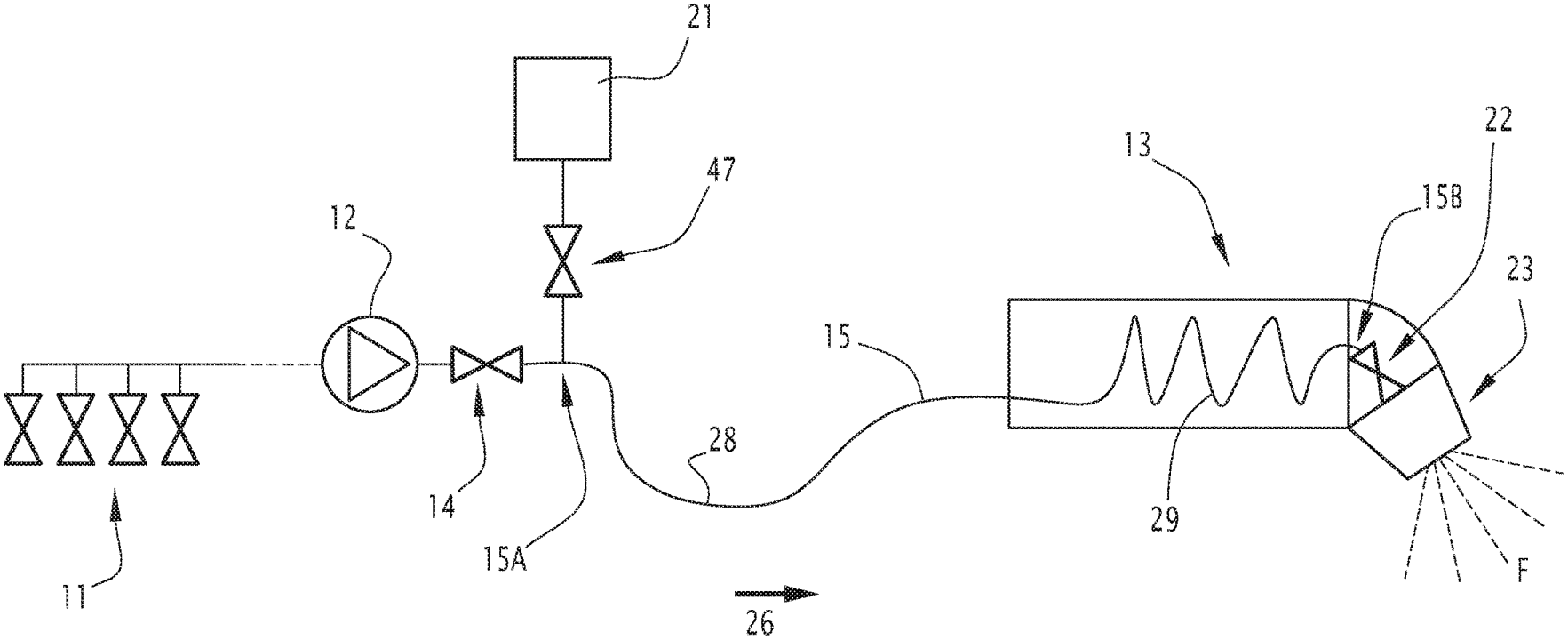
FIG. 1 is a schematic illustration of a first exemplary installation for spraying fluid comprising a fluid circulation pipe and a scraper.

A first example exemplary installation for spraying a fluid 10 is shown in FIG. 1.

The installation 10 is configured to spray a first fluid F.

The installation 10 for example comprises a color-changing unit 11, a pump 12 and a member 13 for spraying the first fluid F, such as a paint gun or a sprayer.

The installation 10 further includes a fluid F circulation pipe 15, a scraper 20 and at least one injector 21.

The color-changing unit 11, the pump 12, the circulation pipe 15 and the spraying member 13 jointly form a circuit 16 for circulation of the first fluid F. The circuit 16 is, in particular, capable of conducting the first fluid F from the color-changing unit 11 to the spraying member 13.

The first fluid F is for example a liquid, such as a paint or another coating product.

According to one embodiment, the first fluid F includes a set of electrically conductive particles, in particular, metal particles such as aluminum particles.

The color-changing unit 11 is configured to supply the pump 12 with the first fluid F. In particular, the color-changing unit 11 is configured to supply the pump 12 with a plurality of first fluids F, and to switch the supply of the pump 12 from one first fluid F to another first fluid F.

In particular, each of the first fluids F with which the color-changing unit 11 is capable of supplying the pump 12 is, for example, a paint having a different color from the colors of the other first fluids F.

The pump 12 is capable of injecting, into the circulation pipe 15, a flow rate of the first fluid F received from the color-changing unit 11. For example, the pump 12 is connected to the circulation pipe 15 by a valve 14.

The pump 12 is for example a gear-type pump.

The spraying member 13 is capable of receiving the first fluid F and spraying the first fluid F.

For example, the spraying member 13 includes a valve 22 and a spray head 23.

The spraying member 13 is, for example, mounted on a moving arm capable of orienting the spraying member 13 toward an object on which the first fluid F must be sprayed.

The valve 22 is configured to connect the circulation pipe 15 to the spray head 23, and to switch between an open configuration allowing the passage of first fluid F from the circulation pipe 15 to the spray head 23 and a closed configuration preventing this passage.

The spray head 23 is configured to spray the first fluid F received from the valve 22.

The fluid circulation pipe 15 is configured to conduct the first fluid F received from the valve 14 to the spraying member 13.

The fluid circulation pipe 15 is cylindrical. For example, the fluid circulation pipe 15 has a circular section and extends along a first axis A1.

According to one embodiment, the fluid circulation pipe 15 is straight. In a variant, the fluid circulation pipe 15 is a curved pipe for which the first axis A1 is defined locally at any point of the fluid circulation pipe 15 as being perpendicular to a plane in which the section of the fluid circulation pipe 15 is circular.

The fluid circulation pipe 15 has an inner surface 25 delimiting an aperture of the fluid circulation pipe 15 in a plane perpendicular to the first axis A1.

Figure 2:
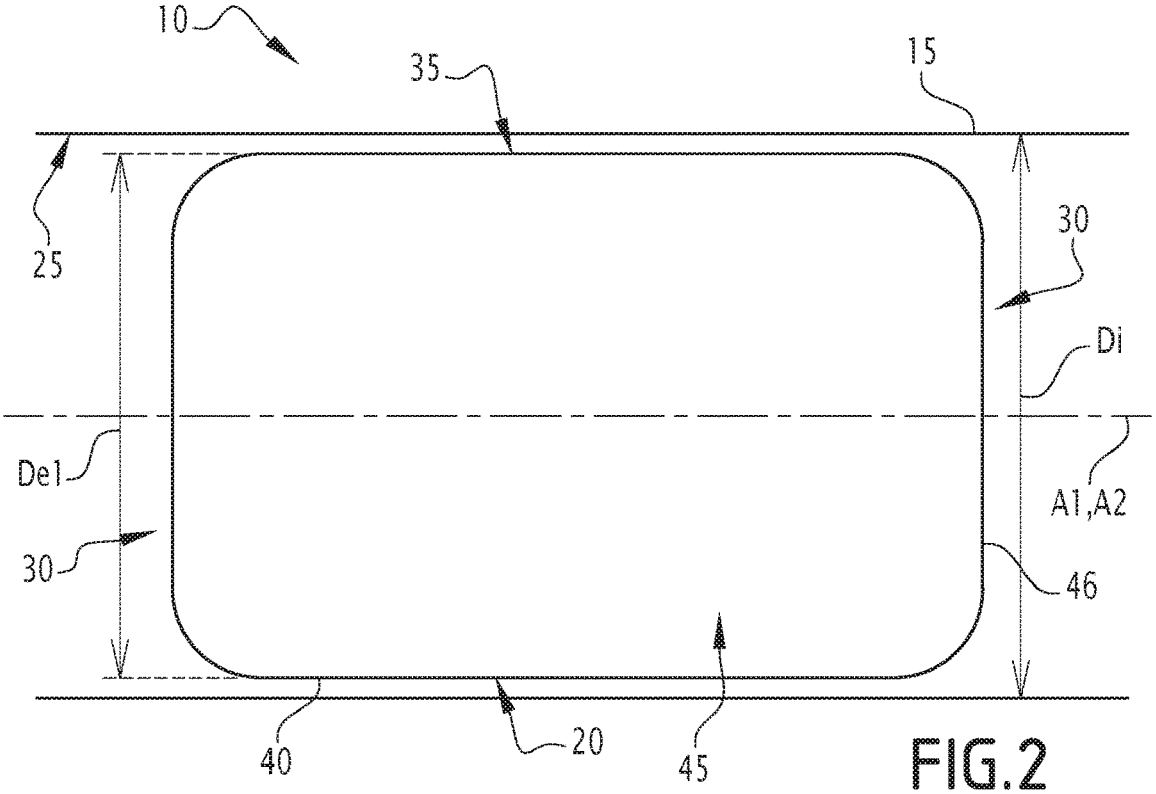
FIG. 2 is a partial schematic sectional illustration of the first exemplary installation for spraying a fluid.
Figure 3:
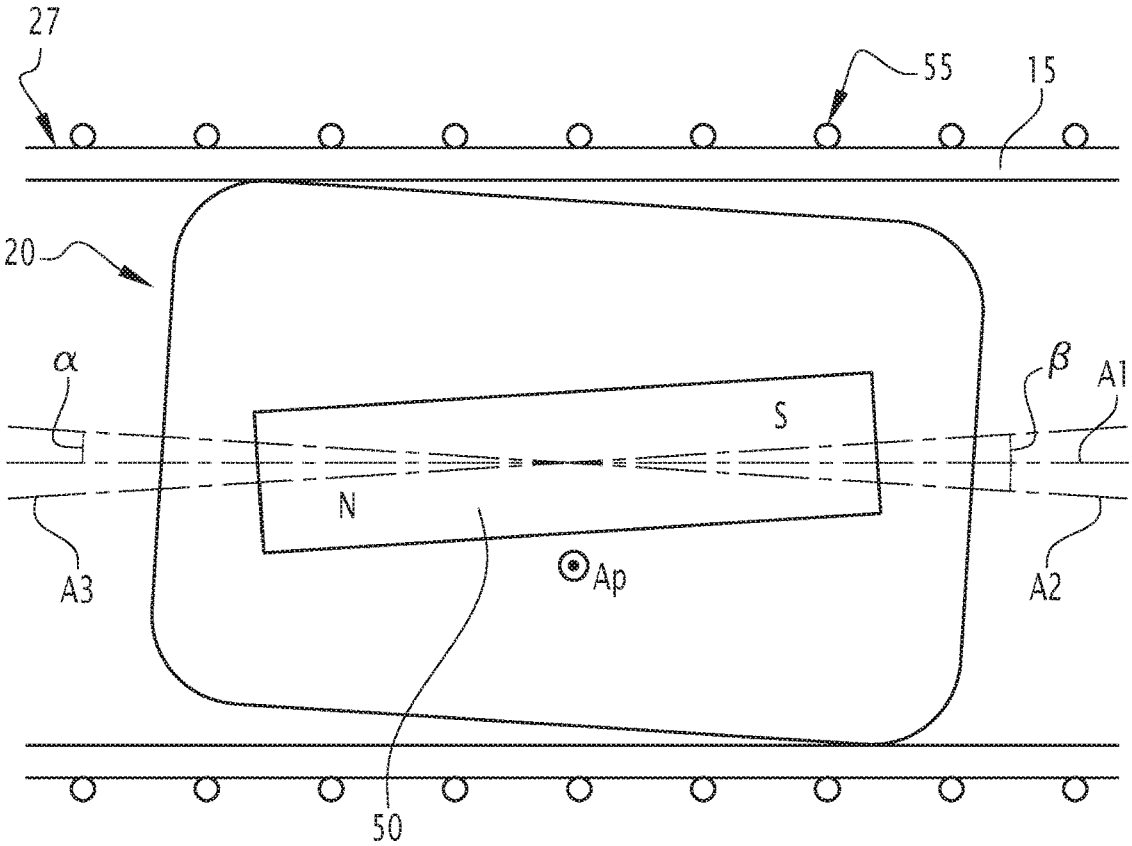
FIG. 3 is a partial schematic sectional illustration of a second exemplary installation for spraying a fluid.

The fluid circulation pipe 15 further has an outer surface 27, which is visible in FIG. 3. In order to simplify FIGS. 1, 2 and 4-7, the outer surface 27 is only shown in FIG. 3.

An upstream direction and a downstream direction are defined for the circulation pipe 15. The upstream direction and the downstream direction are defined in that, during the spraying of the first fluid F, the first fluid F circulates in the circulation pipe 15 from upstream to downstream.

For example, the pump is configured to inject the first fluid at an upstream end 15A of the circulation pipe 15 while a downstream end 15B of the circulation pipe 15 is connected to the sprayer to allow the first fluid F to circulate from upstream to downstream from the pump to the sprayer through the circulation pipe 15. This is shown in FIG. 1 by an arrow 26.

According to the example shown in FIG. 1, the fluid circulation pipe 15 includes a first portion 28 and a second portion 29.

The circulation pipe 15 has a length greater than or equal to 50 centimeters, for example greater than or equal to one meter. According to one embodiment, each of the first portion 28 and the second portion 29 has a length greater than or equal to one meter.

The first portion 28 is arranged upstream from the second portion 29.

The first portion 28 is, for example, configured to deform so as to follow the movement of the spraying member 13.

The second portion 28 is, for example, accommodated in the spraying member 13 and movable therewith.

The second portion 29 is, for example, helical.

An inner diameter Di is defined for the fluid circulation pipe 15. The inner diameter Di is measured in a plane perpendicular to the first axis A1 between two diametrically opposite points of the inner surface 25.

The inner diameter Di is, for example, between 3.8 and 6.2 mm. It should be noted that the inner diameter Di of the circulation pipe 15 may vary.

The fluid circulation pipe 15 is, for example, made from a metallic material. In a variant, the fluid circulation pipe 15 is made from a polymer material.

The scraper 20 is configured to circulate in the fluid circulation pipe 15 in order to push the first fluid F present in the inner surface 25 back in front of it during its movement in the fluid circulation pipe 15. In particular, the scraper 20 is configured to clean the inner surface 25, that is to say, to leave behind it an inner surface 25 covered with a quantity of first fluid F smaller than the quantity covering the inner surface 25 before the passage of the scraper 20, for example to remove all of the first fluid F covering the inner surface 25 of the portions of the pipe 15 in which the scraper 20 circulates.

"Push back in front of it" means that the scraper 20, circulating in a direction in the fluid circulation pipe 15, imposes a movement in this direction on the first fluid F that is received in the portion of the pipe 15 in the direction in which the scraper 20 moves. For example, a scraper 20 moving from upstream to downstream imposes a movement in the downstream direction on the first fluid F located downstream from the scraper 20.

The scraper 20 extends along a second axis A2.

The scraper 20 includes at least one portion having a circular section in a plane perpendicular to the second axis A2.

According to the example of FIG. 2, the scraper 20 is substantially cylindrical and has a symmetry of revolution around the second axis A2.

The scraper 20 is provided to circulate in the circulation pipe 15 when the scraper 20 is received in the aperture of the circulation pipe 15 and the first axis A1 is combined with the second axis A2, as shown in FIG. 2.

The scraper 20 has an outer diameter. The outer diameter is the outer diameter of the portion of the scraper 20 having the largest outer diameter in a plane perpendicular to the second axis A2.

The outer diameter has a first value De1.

The first value De1 is strictly less than the inner diameter Di of the circulation pipe 15.

A difference between the inner diameter Di of the circulation pipe 15 and the first value De1 is greater than or equal to 100 micrometers (μm). For example, the difference is greater than or equal to 200 μm.

The difference is less than or equal to 300 μm.

According to one embodiment, the difference is equal to 200 μm.

The scraper 20 has two end faces 30 delimiting the scraper 20 along the second axis A2. A length of the scraper 20 measured along the second axis A2 between the two end faces 30, is comprised between the inner diameter Di of the circulation pipe 15 and twice the inner diameter Di.

The scraper 20 further has a side face 35 delimiting the scraper 20 in a plane perpendicular to the second axis A2. When the scraper 20 is substantially cylindrical, the outer diameter is measured between two diametrically opposite points of the side face 35.

The scraper 20 for example includes a shell 40 delimiting a chamber 45. In this case, the end faces 30 and the side face 35 are outer faces of the shell 40. In particular, the shell 40 includes two end walls 46 that separate, along the second axis A2, the chamber 45 from the outside of the shell 40. In this case, the end faces 30 are faces of the end walls 46.

The end walls 46 are, for example, flat walls perpendicular to the second axis A2.

The shell 40 is for example made from polytetrafluoroethylene (PTFE), polyethylene, a polyolefin, polyether ether ketone (PEEK), polyoxymethylene (POM), or polyamide.

In a variant, the scraper 20 is solid, that is to say, no chamber 45 is delimited by the shell 40. In this case, the scraper 20 will be made from a material having good resilient properties, such as an elastomer, in particular a perfluorinated elastomer, resistant to solvents.

The injector 21 is configured to inject a second fluid into the circuit 16, in particular into the circulation pipe 15. For example, the injector 21 is configured to inject a stream of second fluid having a flow rate controllable by the injector 21 into the circulation pipe 15.

The injector 21 is for example configured to inject the second fluid into the upstream end 15A of the circulation pipe 15. In a variant, the injector 21 is configured to inject the second fluid into the downstream end 15B of the circulation pipe 15, or is configured to inject the second fluid either into the upstream end 15A or into the downstream end 15B.

According to the example of FIG. 1, the injector 21 is connected by a valve 47 to the circulation pipe 15.

The second fluid is for example a separate fluid from the fluid F to be sprayed. For example, the second fluid is a liquid, sometimes called "cleaning liquid". The liquid is, in particular, a solvent capable of dissolving or diluting the first fluid F. For example, when the first fluid F is a paint with an aqueous base, the liquid is water. It should be noted that the type of solvent used may vary, in particular depending on the nature of the first fluid F.

It should also be noted that liquids other than solvents may be used as second fluid.

In a variant, the second fluid is a first fluid F intended to be sprayed after the first fluid F present in the circulation pipe 15, for example, a first fluid F having a different color from the first fluid F present in the circulation pipe 15. According to another variant, the second fluid is a gas such as compressed air.

Many types of injector 21 can be used in the installation 10, as a function of the second fluid to be injected. For example, the injector 21 is a gear-type pump, or a compressor capable of generating a gas stream.

It should be noted that, although the injector 21 has been described previously as a separate device from the pump 12, it is conceivable for the role of the injector 21 to be performed by the pump 12, for example, if the color-changing unit 11 comprises a second fluid reservoir that the pump 12 is then capable of injecting into the pipe 15.

A first example of a method for moving the first fluid F into the installation 10 will now be described.

The method is, for example, a method for cleaning the inner surface 25 of the pipe 15. It should be noted that applications of the method other than cleaning the pipe 15 can be considered.

During an initial step, first fluid F is present in the aperture of the circulation pipe 15. For example, the first fluid F partially covers the inner surface of the circulation pipe 15.

During a circulation step, the scraper 20 circulates in the circulation pipe 15. For example, the scraper 20 is inserted at one end 15A, 15B of the circulation pipe 15 and propelled to the other end 15A, 15B of the circulation pipe 15 by a stream of second fluid.

The stream of second fluid then exerts, on one of the end faces 30, a force tending to propel the scraper into the circulation pipe 15 along the first axis A1.

During the circulation step 20, the first axis A1 and the second axis A2 are combined.

Under the effect of the stream of second fluid, the scraper 20 circulates in the circulation pipe 15. For example, when the stream of second fluid is injected into the upstream end 15A of the pipe 15, the scraper 20 circulates from upstream to downstream. It should be noted that the circulation direction of the scraper 20 is capable of varying, for example, if the stream of second fluid is injected into the downstream end 15B of the pipe 15.

During its circulation, the scraper 20 pushes the first fluid F present in the circulation pipe 15 back in front of it, thus allowing the recovery of the first fluid F. For example, a recovery valve of the first fluid F emerging in the downstream end of the pipe 15 allows the first fluid F pushed back by the scraper 20 to exit. In a variant, the first fluid F leaves the circulation pipe through the valve 22 of the spraying member 13.

The inner surface 25 of the circulation pipe 15 is therefore cleaned, since the scraper pushes the first fluid F present on the inner surface 25 of the pipe 15 back in front of it.

Since the difference between the first outer diameter value De1 of the scraper 20 and the inner diameter Di of the circulation pipe 15 is greater than or equal to 100 μm, the friction between the scraper 20 and the inner surface 25 is limited. The wear of the scraper and the circulation pipe 15 is therefore lower than for the installations of the state of the art. However, the first fluid F is effectively collected by the scraper 20.

A difference greater than or equal to 200 μm particularly decreases the friction and therefore the wear.

In the second, third and fourth exemplary installations mentioned hereinafter and their variants, the elements identical to the first example of FIG. 2 and the first exemplary movement method are not described again. Only the differences are shown.

A second exemplary installation 10 is shown in FIG. 3.

The installation 10 includes a maintaining system configured to prevent a relative translational movement of the scraper 10 with respect to the circulation pipe 15 when the scraper 20 is inserted into the circulation pipe 15, and which is no longer desired when the first fluid F is moved in the circulation pipe 15.

The maintaining system is, in particular, configured to pivot the scraper 20 around a pivot axis Ap. The pivot axis Ap is perpendicular to the first axis A1.

More specifically, the maintaining system is configured to pivot the scraper 20 between a first position in which the first axis A1 and the second axis A2 are combined and a second position in which an angle α between the first axis A1 and the second axis A2 is strictly greater than zero.

The angle α is, for example, greater than or equal to 0.5 degrees)(°.

When the scraper 20 is in the second position, as shown in FIG. 3, the scraper 20 is pressed at each of its ends against the inner surface 25 of the circulation pipe 15.

Since the scraper 20 has an outer diameter De1 strictly smaller than the inner diameter Di of the circulation pipe 15, the scraper 20 is capable of moving in the circulation pipe 15 without the second fluid F upstream being set in motion, for example, under the influence of gravity. This, in particular, happens each time the spraying is stopped.

Owing to the maintaining system, the risk of an unwanted movement of the scraper 20 is limited.

According to one embodiment, the maintaining system includes a magnet 50 and a magnetic field generator 55.

The magnet 50 is secured to the scraper 20. The magnet 50 is for example accommodated in the chamber 45.

The magnet 50 is for example a permanent magnet, such as a neodymium magnet.

However, embodiments in which the magnet 50 is an electromagnet are also conceivable.

The magnet 50 has a north pole N and a south pole S. The north N and south S poles of the magnet 50 are aligned along a third axis A3.

The third axis A3 is not combined with the second axis A2. In particular, the third axis A3 forms an angle β with the second axis A2 of the scraper 20.

The angle β is greater than or equal to the angle α between the first axis A1 and the second axis A2. The angle β is greater than or equal to 5°.

The magnetic field generator 55 is configured to generate, in at least one portion of the circulation pipe 15, a magnetic field M tending to align the first axis A1 and the third axis A3.

The magnetic field generator 55 is, for example, arranged outside the circulation pipe 15. According to the example shown in FIG. 3, the magnetic field generator is in contact with the outer surface 27 of the circulation pipe 15.

In a variant, the magnetic field generator is at least partially comprised in the circulation pipe 15. In particular, the magnetic field generator is at least partially comprised between the outer surface 27 and the inner surface 25 of the circulation pipe 15.

The magnetic field generator 55 is, for example, an electromagnet comprising a conductive winding surrounding at least a portion of the circulation pipe 15. In this case, when the electromagnet 55 is supplied by an electric current, the electromagnet 55 generates, in the circulation pipe 15, a magnetic field M oriented parallel to the first axis A1.

According to the example of FIG. 3, the conductive winding is wound around the circulation pipe 15, and is therefore in contact with the outer surface 27. In a variant, the conductive winding can be comprised between the outer 27 and inner 25 surfaces of the pipe 15. Thus, the conductive winding is integrated into the pipe 15.

According to one variant, the magnetic field generator 55 is a permanent magnet. For example, the magnetic field generator 55 is a permanent magnet when the magnet 50 is an electromagnet.

According to one specific embodiment, the magnetic field generator 55 includes a permanent magnet and the magnet 50 is a permanent magnet. For example, the permanent magnet of the magnetic field generator 55 is movable relative to the circulation pipe 15 between a first position in which the magnetic field generator 55 generates a negligible magnetic field in a portion of the circulation pipe 15, and a second position in which the magnetic field generator 55 generates, in at least one portion of the circulation pipe 15, a magnetic field M tending to align the first axis A1 and the third axis A3.

According to another embodiment, the magnetic field generator 55 and the magnet 50 are both electromagnets.

The second example method includes a pivoting step.

The pivoting step is for example carried out after the circulation step. In particular, the pivoting step is carried out when the scraper 20 is accommodated in the aperture of the circulation pipe 15, but it is desirable for the scraper 20 not to be able to move in translation along the first axis A1 relative to the circulation pipe 15, for example when the circulation pipe 15 must be moved or the first axis A1 of the circulation pipe 15 has a non-negligible vertical component and the scraper 20 could slide in the circulation pipe 15 under the effect of its weight.

During the pivoting step, the scraper 20 pivots from its first position to its second position.

In particular, the electromagnet 55 generates the magnetic field M, which imposes a magnetic force on the scraper 20 tending to align the third axis A3 with the first axis A1. The scraper 20 therefore pivots around the pivot axis Ap to its second position.

The magnetic force presses the two ends of the scraper 20 against the inner surface 25 of the circulation pipe 15, which prevents, by friction, a translational movement of the scraper along the first axis A1 relative to the circulation pipe 15.

The maintaining system then makes it possible to keep the scraper 20 in position in a particular portion of the circulation pipe 15 despite the reduction in friction between the scraper 20 and the circulation pipe 15 due to the difference in the inner and outer diameters Di and De1. This immobilization is, in particular, useful for the case of interruption of the circulation step before the entire pipe 15 has been traveled by the scraper 20.

Figure 4:
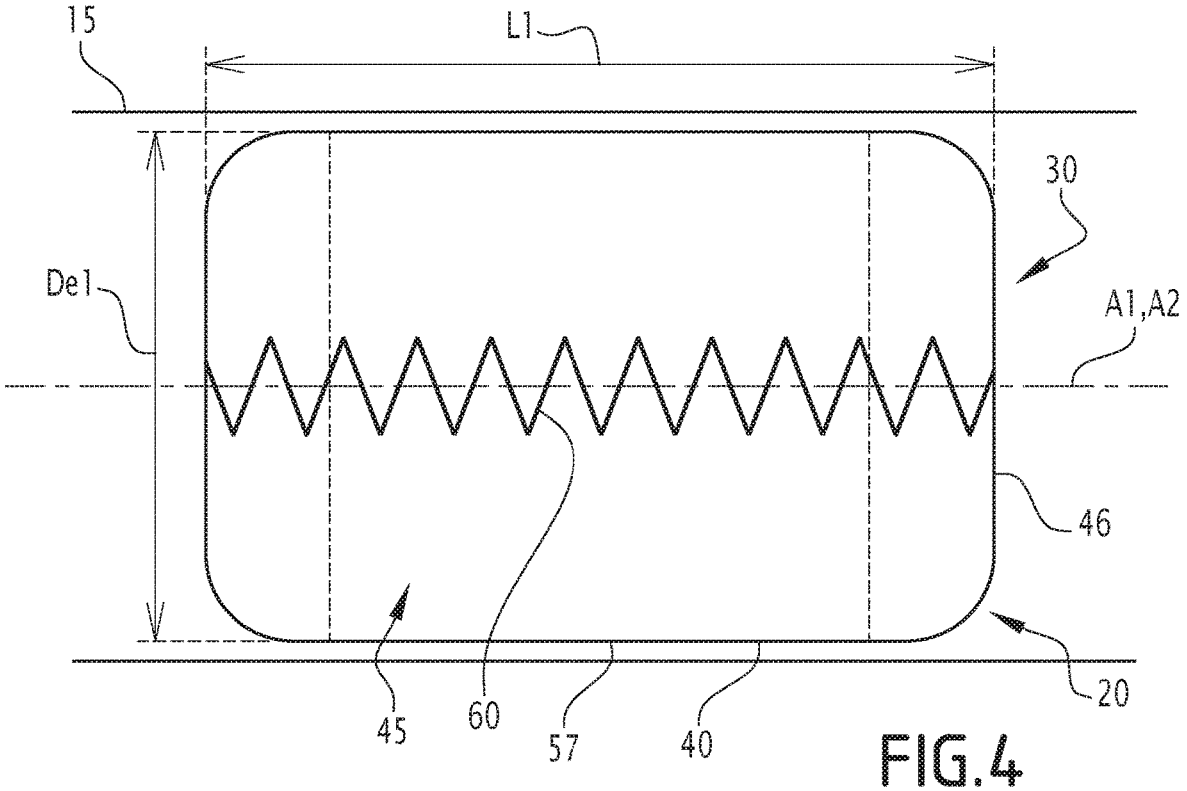
FIG. 4 is a partial schematic sectional illustration of a third exemplary installation for spraying a fluid comprising a pipe, a pressure in the pipe being equal to a first value.

A third exemplary installation 10 is shown in FIG. 4.

The third example installation 10 also includes a maintaining system configured to prevent a relative translational movement of the scraper 10 with respect to the circulation pipe 15 when the scraper 20 is inserted in the circulation pipe 15.

The maintaining system is configured to increase the outer diameter of at least a portion of the scraper 20 from the first diameter value De1 to a second diameter value De2.

The second diameter value De2 is strictly greater than the first diameter value De1.

In particular, the second diameter value De2 is equal to the inner diameter Di.

The injector 21 is able to vary the pressure in the circulation pipe 15 when the exit of the first fluid F through the downstream end of the pipe 15 is prevented, for example when the valve 22 of the spraying member 13 is closed.

In particular, the injector 21 is configured to vary the pressure in the circulation pipe between a first pressure value and a second pressure value.

The first pressure value is a typical pressure value for the operation of the installation 10 when the scraper 20 circulates in the circulation pipe 15.

The first pressure value is, for example, between 2 bar and 8 bar. It should be noted that the first value can vary.

The second pressure value is strictly greater than the first pressure value. The second pressure value is for example greater than or equal to 10 bar. According to one embodiment, the second pressure value is equal to 10 bar, to within 500 millibar.

The scraper 20 is configured to be crushed along the second axis A2 when the pressure in the circulation pipe 15 is greater than or equal to a predetermined pressure threshold.

Figure 5:
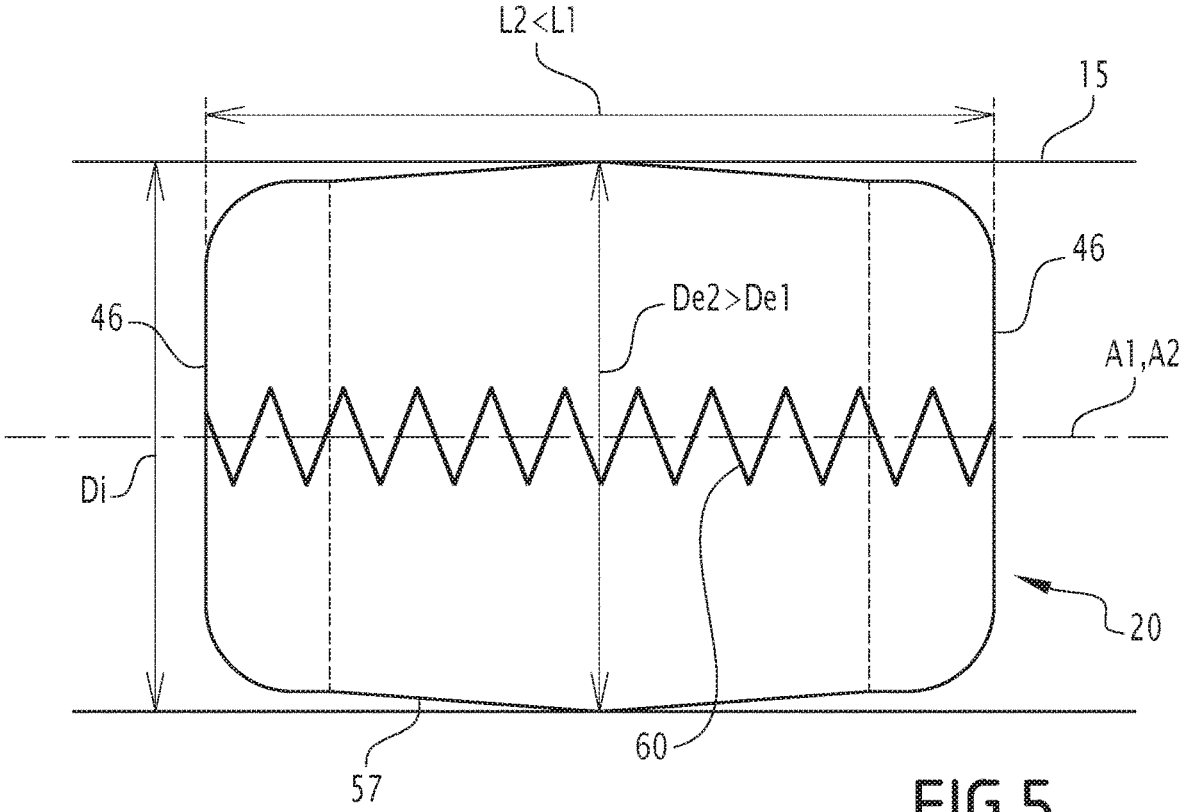
FIG. 5 is a partial schematic sectional illustration of the installation of FIG. 4, the pressure in the pipe being equal to a second value strictly greater than the first value.

In other words, the scraper 20 has an uncrushed configuration, shown in FIG. 4, and a crushed configuration, shown in FIG. 5. The length L1 of the scraper 20, along the second axis A2, in the uncrushed configuration, is strictly greater than the length L2 of the scraper 20 in the crushed configuration.

The pressure threshold is strictly greater than the first pressure value and strictly lower than the second pressure value.

Furthermore, the scraper 20 is configured so that the crushing of the scraper 20 causes an increase in the outer diameter of the scraper 20 from the first value De1 to the second value De2. Thus, in the uncrushed configuration, the outer diameter of the scraper 20 has the first diameter value De1, whereas in the crushed configuration, the outer diameter has the second diameter value De2.

In one embodiment, in the crushed configuration, the outer diameter has a value strictly greater than the inner diameter Di of the circulation pipe 15 when the scraper 20 is not accommodated in the circulation pipe 15. Thus, when the scraper 20 is accommodated in the circulation pipe 15 in the crushed configuration, the outer diameter of the scraper 20 has the second diameter value De2 because the outer diameter of the scraper 20 is limited by the inner diameter Di. The scraper 20 then exerts, against the inner surface 25 of the circulation pipe 15, a frictional force tending to keep the scraper 20 in position relative to the circulation pipe 20.

For example, the shell 40 is made from a flexible polymer material and provided so that a central portion 57 of the shell 40 deforms radially toward the outside of the shell 40 when the end walls 46 are brought closer to one another.

The flexible polymer material is for example chosen from among a perfluorinated polymer, Teflon, polyamide and a polyolefin.

According to the example of FIGS. 1 and 5, the scraper 20 includes a resilient element 60.

The injector, the shell 40 and the resilient element 60 jointly form the maintaining system.

The resilient element 60 is accommodated in the chamber 45 delimited by the shell 40.

The resilient element 60 exerts, on the end walls 46, a resilient force seeking to separate the end walls 46 from one another. In particular, the resilient element 60 is configured to exert a resilient force having a value strictly greater than a pressure force tending to bring the end walls 46 closer to one another when the pressure in the circulation pipe 15 is below or equal to the pressure threshold.

The resilient element 60 is further configured to exert a resilient force having an intensity strictly greater than a pressure force tending to bring the end walls 46 closer to one another when the pressure in the circulation pipe 15 is strictly greater than the pressure threshold.

In other words, the resilient element 60 is configured to keep the scraper 20 in its uncrushed configuration when the pressure in the circulation pipe 15 is below or equal to the pressure threshold, and to allow the scraper 20 to switch to its crushed configuration when the pressure is strictly greater than the pressure threshold.

The resilient element 60 is, for example, a spring such as a helical spring. It should be noted that other types of resilient elements 60 can be considered.

The operation of the third example will now be described. In particular, a third example movement method implemented by the third example installation 10 will now be described.

During the circulation step, the pressure in the circulation pipe 15 has the first pressure value. The scraper 20 is therefore in its uncrushed configuration.

The third example comprises a step for increasing the pressure and a crushing step.

During the step for increasing the pressure, the injector increases the pressure in the circulation pipe from the first value to the second value. For example, the valve 22 allowing the first fluid F to exit from the circulation pipe 15 is closed, and the injector injects second fluid into the circulation pipe 15 until the second pressure value is reached.

During the crushing step, the scraper 20 switches into its crushed configuration under the effect of the pressure force exerted on the end walls 46. The crushing causes an increase in the outer diameter of the scraper 20 to the second diameter value De2.

When the scraper 20 is in its crushed configuration, the scraper 20 exerts a frictional force against the inner surface 25 of the circulation pipe 15, since the outer diameter is equal to the inner diameter Di.

The maintaining system then makes it possible to keep the scraper 20 in position in a particular portion of the circulation pipe 15 when the scraper 20 is crushed, while allowing a reduction in friction between the scraper 20 and the circulation pipe 15 due to the difference in the inner and outer diameters Di and De1 in the uncrushed configuration.

The maintaining system of the third example does not assume additional equipment except for the resilient element 60, relative to the first example. In particular, no additional element outside the scraper 20 is required. The fluid spraying installation 10 is therefore very simple, and the scraper 20 is capable of being used in pre-existing fluid spraying installations 10.

According to a variant of the third example, the scraper 20 does not include a resilient element 60. The shell 40 includes two end portions 65 and one crushing portion 70.

The two end portions 65 delimit the scraper 20 along the second axis A2. In particular, each end wall 46 is a wall of an end portion 65. This end portion is delimited by the end wall 46 along the second axis 20.

Each end portion 65 is, for example, rigid. In particular, each end portion 65 is configured so as not to be deformed when the scraper 20 goes from the crushed configuration to the uncrushed configuration or vice versa. The crushing portion 70 is inserted along the second axis A2 between the two end portions 65.

The crushing portion 70 is cylindrical and extends along the second axis A2. The crushing portion 70 therefore has a circular section in a plane perpendicular to the second axis A2.

The crushing portion 70 is configured to exert, on the two end portions 65, a force tending to separate the two end portions 65 from one another.

In particular, the crushing portion 70 is configured to exert a resilient force having a value strictly greater than a pressure force tending to bring the two end portions 65 closer to one another when the pressure in the circulation pipe 15 is below or equal to the pressure threshold.

The crushing portion 70 is further configured to exert a resilient force having a value strictly greater than a pressure force tending to bring the two end portions 65 closer to one another when the pressure in the circulation pipe 15 is strictly greater than the pressure threshold.

In other words, the crushing portion 70 is configured to keep the scraper 20 in its uncrushed configuration when the pressure in the circulation pipe 15 is below or equal to the pressure threshold, and to allow the scraper 20 to switch to its crushed configuration when the pressure is strictly greater than the pressure threshold.

The crushing portion 70 is, for example, made from an elastomer material. In this sense, the portion 70 can be qualified as elastomeric portion.

Figure 6:
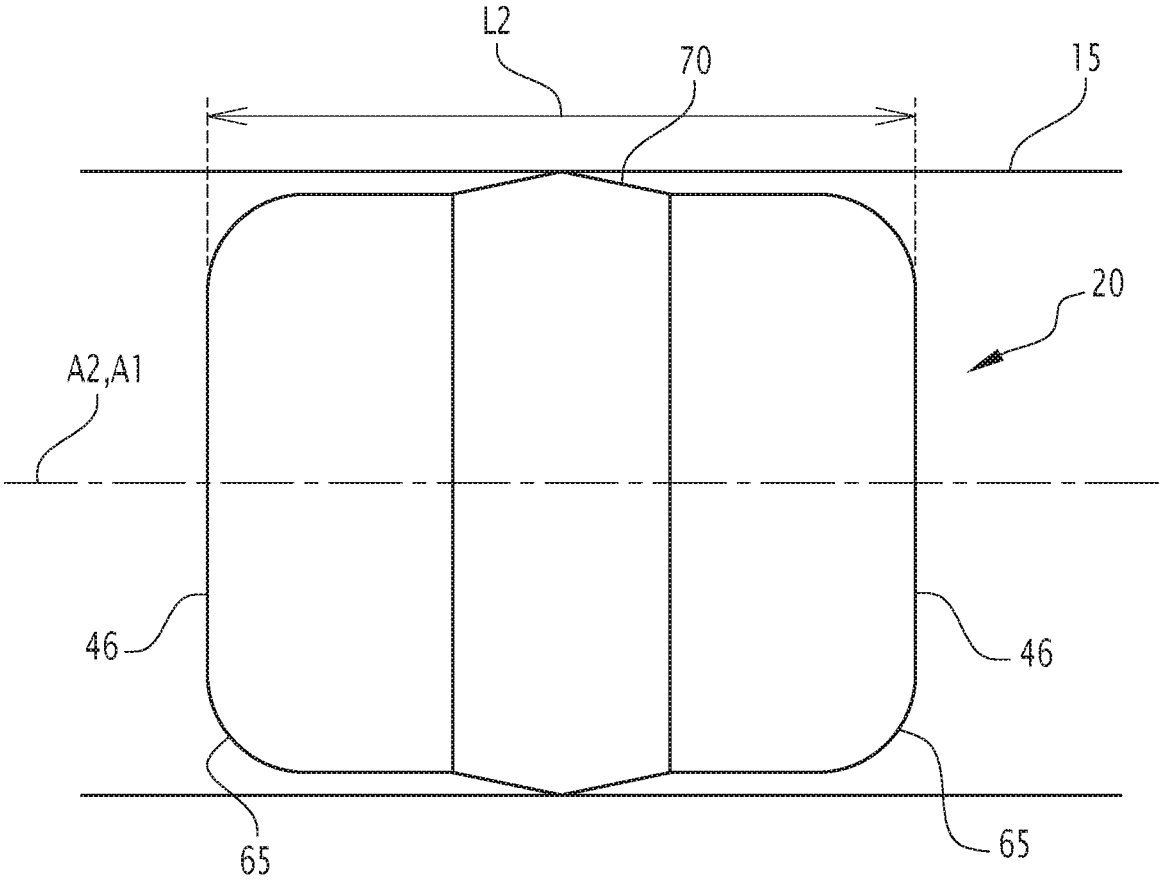
FIG. 6 is a partial schematic sectional illustration of a variant of the third exemplary installation for spraying a fluid, the pressure in the pipe being equal to the second value.

The crushing portion 70 is configured to deform radially toward the outside of the shell 40 when the two end portions 65 are brought closer to one another, as shown in FIG. 6.

A fourth exemplary installation 10 will now be described.

The scraper 20 comprises a ferromagnetic element.

Ferromagnetism refers to the ability of certain bodies to become magnetized under the effect of an outside magnetic field and to retain a portion of that magnetization.

The ferromagnetic element is, in particular, secured to the shell 40.

The ferromagnetic element is, for example, received in the chamber 45.

The installation 10 comprises a magnetic field generator 55.

The magnetic field generator 55 is, for example, similar to the magnetic field generators 55 used in the second example previously described.

The magnetic field generator 55 is configured to generate, in at least one portion of the circulation pipe 15, a magnetic field tending to bring the ferromagnetic element closer to the magnetic field generator 55.

For example, the magnetic field generator 55 is a magnet generating a magnetic field capable of attracting the ferromagnetic element toward the magnet.

The method then comprises an attraction step for example replacing the pivoting step.

During the attraction step, the magnetic field generator 55 generates the magnetic field in the corresponding portion of the circulation pipe 15. For example, when the magnetic field generator 55 is a permanent magnet, the magnetic field generator 55 is brought closer to the portion of the circulation pipe 15 in which it is desired for the scraper 20 to be maintained.

Under the effect of the magnetic field, the ferromagnetic element is attracted toward the magnetic field generator 55. As a result, the scraper 20 is moved into the pipe 15 until coming into contact with the inner surface 25 of the pipe 15. In particular, the scraper 20 is pressed against the inner surface 25.

The scraper 20 is then kept in position in the portion of the pipe 15 by the effect of the magnetic field, which presses the scraper against the inner surface 25.

The fourth exemplary installation 10 is particularly simple to implement.

A method for spraying a first fluid F will now be described.

The spraying method is for example implemented by a spraying installation 10 according to one of the exemplary spraying installations 10 previously described. However, it should be noted that the spraying method can be implemented by other types of fluid spraying installations, in particular, fluid spraying installations in which the difference between the inner diameter Di of the circulation pipe 15 and the first value De1 is strictly less than 100 micrometers, for example equal to zero.

The method comprises a first spraying step, a circulation step, a return step and a second spraying step.

During the first spraying step, a first fluid F is sprayed by the spraying installation 10. In particular, the first fluid F is injected by the pump 12 into the circulation pipe 15 and transmitted by the circulation pipe 15 to the spraying member 13, which sprays the first fluid F.

The first fluid F is, for example, sprayed on a zone of an object, a structure or an installation that one wishes to cover with first fluid F.

The first fluid F sprayed during the first spraying step, for example, has a first color.

The first spraying step comprises determining a first volume of first fluid F. The first volume is the volume of first fluid F that has been sprayed since the beginning of the first spraying step.

The first volume is, for example, determined by knowing the flow rate of the pump 12 and the total operating duration of the pump 12 from the beginning of the first spraying step.

The first spraying step is implemented until a difference between a total volume of first fluid F to be sprayed and the first volume is equal to a predetermined second volume.

The total volume is, for example, the total volume of first fluid F to be sprayed by the installation 10 in order to make it possible to cover a predetermined object, or a predetermined zone of an object, a structure or an installation, with first fluid F.

The second volume is the volume of first fluid F that the scraper 20 is capable of moving during the circulation step. For example, the second volume is determined experimentally by filling the circulation pipe 15 with first fluid F and implementing the circulation step.

The second volume is, for example, greater than or equal to 80 percent (%) of the volume of the aperture of the circulation pipe 15.

The second volume is, for example, the volume of first fluid F contained in the circulation pipe 15. In particular, the second volume is the volume of the aperture of the circulation pipe 15.

In other words, the first spraying step is carried out until the volume of first fluid F that is contained in the circulation pipe 15 and that can be pushed back to the spraying member 13 by the scraper 20 is sufficient to cover, with first fluid F, the zones of the object, the structure or the installation that one wishes to cover F but that have not yet been covered.

The circulation step is implemented after the first spraying step.

During the circulation step, the scraper 20 is introduced into the circulation pipe 15, for example, at the upstream end 15A of the circulation pipe 15, and the injector 21 injects the second fluid upstream from the scraper 20.

The second fluid used during the circulation step is, for example, a liquid, in particular, a solvent capable of dissolving or diluting the first fluid F.

During the circulation step, the valve 22 is open.

The scraper 20 circulates from upstream to downstream in the circulation pipe 15, under the effect of the second fluid injected into the upstream end 15A by the injector 21. For example, the scraper 20 travels a length of the circulation pipe 15 greater than or equal to half of a total length of the circulation pipe 15, in particular, greater than or equal to 90% of the total length.

The scraper 20 pushes back part of the first fluid F present in the circulation pipe 15 up to the spraying member 13, in particular, up to the spray head 23.

During the circulation step, the second volume of first fluid F is pushed back by the scraper 20 to the spray head 23. In other words, during the circulation step, the volume of first fluid F passing through the valve 22 is equal to the second volume.

The first fluid F pushed back by the scraper 20 to the spray head 23 is sprayed by the spray head 23.

The return step is implemented after the circulation step.

During the return step, the injector 21 injects second fluid into the circulation pipe 15 downstream from the scraper 20. The second fluid then pushes the scraper 20 back, which moves in the upstream direction in the circulation pipe.

For example, the valve 17 is open to allow the second fluid to leave the circulation pipe 15 upstream from the scraper 20.

At the end of the return step, the scraper 20 is removed from the circulation pipe 15.

The return step is followed by the second spraying step.

The second spraying step is identical to the first spraying step with the exception of the first sprayed fluid F. In particular, during the second spraying step, the first fluid F injected by the pump 12 into the circulation pipe 15 and sprayed by the spraying member 13 is a different first fluid F from the first fluid F that is injected by the pump 12 during the first spraying step. In particular, the first fluid F sprayed during the second spraying step has a different color from the color of the first fluid F sprayed during the first spraying step.

The spraying method allows the use of a larger portion of the first fluid F that is present in the circulation pipe 15 owing to the use of the scraper 20 to push this first fluid F back to the spraying member 13. The spraying method therefore has a better efficiency in terms of quantity of fluid consumed than the other spraying methods, in which a portion of the consumed fluid remains in the circulation pipe 15 at the end of the spraying, and is effectively not recovered.

When the second fluid is a liquid, the control of the second volume of sprayed fluid is improved, since the liquids are weakly compressible.

When this liquid is a solvent, the first fluid F remaining in the circulation pipe 15 after the passage of the scraper 20, in particular, the first fluid F capable of partially covering the inner surface 25, is dissolved or diluted by the solvent and extracted from the pipe 15 with the solvent. The pipe 15 is therefore partially cleaned, and the risks of contamination of the first fluid F sprayed during the second spraying step by the first fluid F sprayed during the first spraying step are limited.

The cleaning of the pipe 15 is further improved when the return step is implemented using this solvent used as second fluid, since the circulation pipe 15 is then cleaned twice by the solvent, during the circulations of the scraper in the downstream direction, then the upstream direction.

When the scraper 20 is according to the scrapers 20 described in the first, second, third and fourth preceding examples, that is to say, when a difference between the inner diameter Di of the circulation pipe 15 and the first value De1 is greater than or equal to 100 micrometers (μm), the scraper 20 circulates easily even in the portions of the circulation pipe 15 that are not straight, in particular in the second portion 29, which is helical. The quantity of first fluid F recovered is then increased, since a section of the pipe 15 unable to be traveled by the scraper 20 is then prevented from being filled with first fluid at the end of the circulation step.

The use of a second helical portion 29 makes it possible to prevent the formation, in the first fluid F contained in the second portion 29, of conductive connections under the effect of the electrical fields frequently used to spray first fluid F when the first fluid F contains electrically conductive particles. The scrapers 20 according to the first, second, third and fourth examples are therefore particularly interesting for these applications.

A fifth exemplary installation 10 will now be described.

The elements identical to the first example installation 10 are not described again. Only the differences are shown.

However, it should be noted that, in the fifth example installation 10, the difference between the inner diameter Di of the circulation pipe 15 and the first value De1 can vary, in particular, can be strictly less than 100 μm, for example, equal to zero, or can be greater than or equal to 100 μm, as is the case in the first example.

When this difference is greater than or equal to 100 μm, the fifth example installation 10 can comprise a scraper 20 and a maintaining system 55 according to the scrapers 20 and the maintaining systems of the second, third and fourth example installations 10 and the variants previously described these second, third and fourth examples.

According to one variant that can also be considered, the fifth example installation 10 does not include a scraper 20.

The injector 21 is configured to inject the second fluid into at least one from among the color-changing unit 11, the pump 12, the circulation pipe 15 and the spraying member 13. According to the embodiment shown in FIG. 7, the injector 21 is connected to the color-changing unit 11 by a valve 105, to the pump 12 by a valve 110, to the circulation pipe 15 by the valve 47, and to the spraying member 13 by a valve 115.

The second fluid is then a liquid, for example a liquid solvent capable of dissolving or diluting the first fluid F, or water.

The injector 21 is configured to inject a predetermined volume of second fluid into the circuit 16. The injector 21 is further configured to stop the injection when the injected volume is equal to a predetermined volume.

For example, the injector 21 is configured to estimate a value of a total volume of second fluid injected into the circuit 16 from the beginning of the injection, and to stop the injection when the total volume is equal to the predetermined volume.

According to one embodiment, the injector 21 includes a control module such as a data processing unit or a dedicated integrated circuit, capable of estimating the total injected volume and commanding the injection of the second fluid by the injector 21, for example, capable of commanding the opening or the closing of the valves 47, 105, 110, 115. The predetermined volume is chosen as a function of the quantity of second fluid that one wishes to inject into the circuit 16. The predetermined volume is therefore capable of varying.

Examples of injectors 21 capable of being used in the fifth example are described below.

The injector 21 is further configured to inject a gas stream into the circuit 16. In particular, the injector 21 is configured to inject the predetermined volume of second fluid into the circuit 16, and next to inject the gas into the circuit 16 in order to cause the movement of the second fluid in the circuit 16.

For example, the injector 21 is connected to a pressurized gas source.

The gas is for example compressed air.

The gas has a third pressure value when the gas is injected into the circuit 16. The third pressure value is less than or equal to 20 bars.

The fifth example installation 10 is capable of implementing a method comprising a step for injecting the second fluid into the circuit 16.

For example, during the injection step, the second fluid is injected into the circulation pipe 15.

In a variant, the second fluid is injected into at least one from among the color-changing unit 11, the pump 12, the circulation pipe 15, the spraying member 13.

During the injection step, the injector 21 estimates the volume of second fluid injected from the beginning of the injection step. For example, the injector 21 periodically estimates the volume of second fluid injected from the beginning of the injection step. According to one embodiment, the injector 21 estimates the volume of second fluid injected with a period less than or equal to 100 milliseconds.

The estimated volume is compared by the injector 21 to the predetermined volume.

If the estimated volume of second fluid is strictly less than the predetermined volume, the injector 21 continues the injection of the second fluid in the circuit 16.

If the estimated volume is greater than or equal to the predetermined volume, the injector 21 stops the injection. For example, the injector 21 forms the valve(s) 47, 105, 110 and 115 that connect the injector 21 to the circuit 16.

Figure 7:
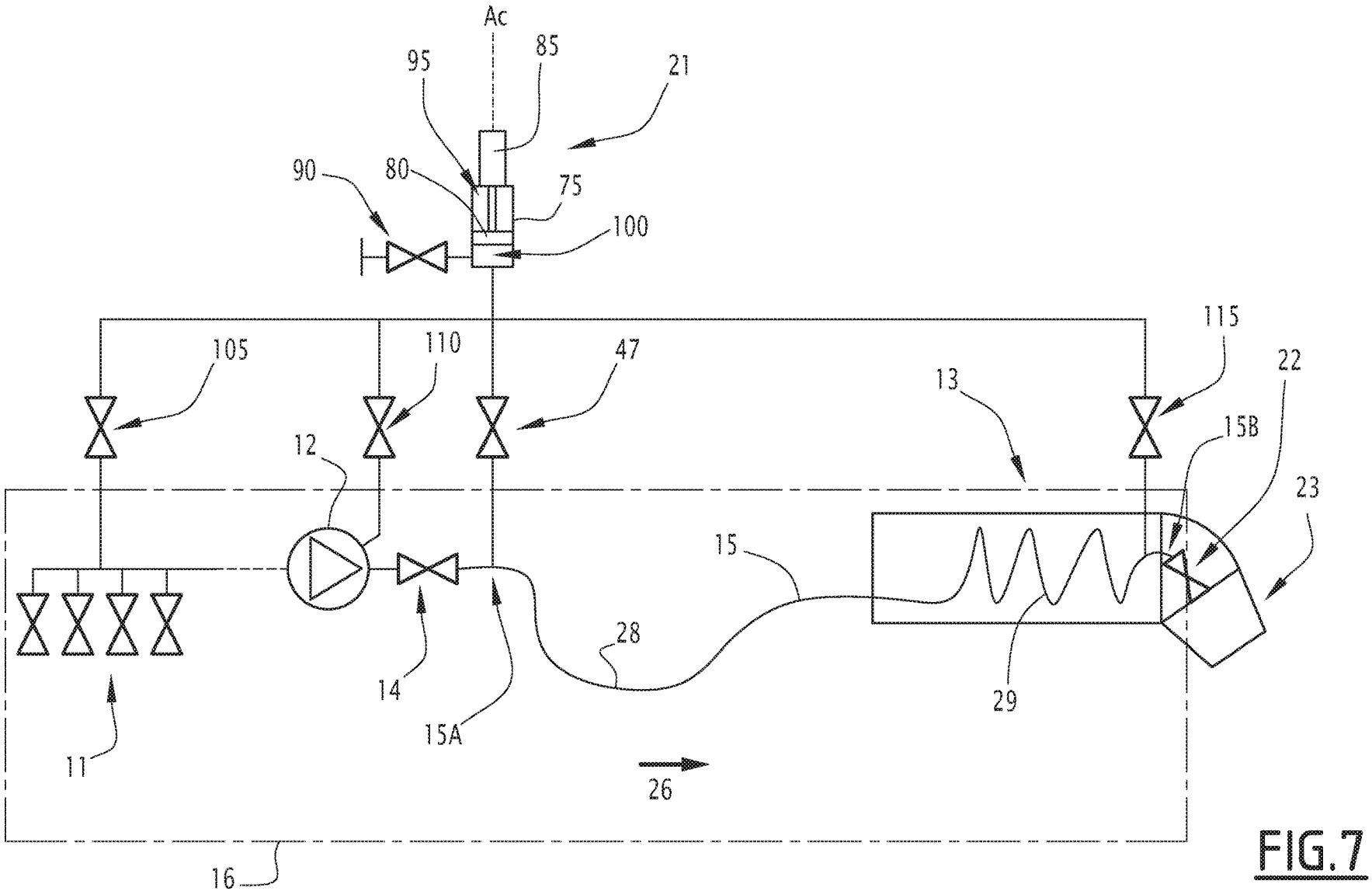
FIG. 7 is a partial schematic sectional illustration of another exemplary installation for spraying a fluid.

According to the example shown in FIG. 7, the injector 21 includes a cylinder 75, a piston 80, an actuator 85 and a valve 90.

The cylinder 75 is configured to contain the second fluid. For example, the cylinder 75 delimits a cylindrical cavity capable of accommodating the second fluid.

The cylinder 75 extends along an axis Ac specific to the cylinder 75.

It should be noted that the cylinder 75 is capable of having a circular base, but also a polygonal base, or a base having any shape in a plane perpendicular to the axis Ac of the cylinder 75.

The cylinder 75 is for example made from a metallic material such as stainless steel or aluminum. The cavity delimited by the cylinder 75 has an inner volume of between 50 cubic centimeters (cc) and 1000 cc.

The piston 80 is accommodated in the cavity delimited by the cylinder 75. The piston 80 separates the cavity delimited by the cylinder 75 into two chambers 95, 100 of variable volume.

The piston 80 is cylindrical, for example, delimited by a peripheral face complementary to an inner face of the cylinder 75 and by two faces perpendicular to the axis of the cylinder 75.

The piston 80 is for example made from a metallic material. According to one embodiment, the face of the piston 80 that delimits the chamber 100 is made from stainless steel. In a variant, this face is made from a polymer, or covered with a layer of polymer, or a layer of polytetrafluoroethylene (PTFE).

The piston 80 is translatable between a primary position and a secondary position relative to the cylinder 75 so as to vary the respective volumes of the chambers 95 and 100. In particular, the piston 80 is movable along the axis Ac of the cylinder 75.

The primary position is the position in which the volume of the chamber 100 is largest. When the piston 80 is in the primary position, the volume of the chamber 95 is for example equal to zero.

The secondary position is the position in which the volume of the chamber 100 is smallest. For example, when the piston 80 is in the secondary position, the piston 80 bears against an end wall of the cylinder 75, such that the volume of the chamber 100 is equal to zero.

The piston 80 is configured to prevent the passage of second fluid between the chambers 95, 100 that delimits. For example, the piston 80 bears sealing means such as a seal surrounding the piston 80 in a plane perpendicular to the axis of the cylinder 75.

The chamber 100 is configured to be at least partially filled with second fluid. For example, the chamber 100 is connected by the valve 90 to a source of second fluid, such as a reservoir.

The chamber 100 is capable of being connected, for example, by the valve 47, to the circulation pipe 15. According to the example of FIG. 7, the chamber 100 is capable of being connected to the upstream end 15A of the circulation pipe. In a variant, the chamber 100 is capable of being connected to the downstream end 15B, or to both ends 15A, 15B.

The actuator 85 is configured to move the piston 80 between its primary and secondary positions. The actuator 85, for example, comprises a motor and a rod capable of transmitting a force from the motor to the piston 80 in order to move the piston 80.

The actuator 85 is, in particular, configured to determine a position of the piston 80 relative to the cylinder 75, and to command or stop a movement of the piston 80 as a function of the determined position. Many types of actuators 85 allow such a determination of the position of the piston.

The motor is, for example, an electric motor such as a torque motor, or a brushless motor.

According to one embodiment, the motor is a servomotor, that is to say, a position-slaved motor. For example, the motor is controlled so as to keep the piston 80 in a predetermined position relative to the cylinder 75, the predetermined position being able to vary.

In a variant, the motor is replaced by a pneumatic or hydraulic member capable of moving the piston 80, for example a pump capable of injecting a liquid into the chamber 95 to move the piston.

The actuator 85 is, in particular, configured to impose a pressure on the second fluid greater than or equal to the third pressure value. For example, a pressure sensor is integrated into the chamber 100, and the control module is capable of commanding an increase in the force exerted by the actuator on the piston 80 until the pressure of the second fluid in the chamber 100 is greater than or equal to the third pressure value.

In a variant, the actuator 85 is configured to estimate the pressure of the fluid in the chamber 100 from values of an electric supply current of the electric motor of the actuator 85.

During the injection step, the chamber 100 contains second fluid and the actuator 85 moves the piston 80 toward the secondary position. For example, during the injection step, the chamber 100 is filled with second fluid.

Under the effect of the movement of the piston 80, the second fluid is injected into the circulation pipe 15.

The actuator 85 periodically determines a position of the piston 80 in the cylinder 75, in particular a distance traveled by the piston 80 along the axis of the cylinder 75 from the primary position. The determination of the distance traveled is equivalent to the determination of the injected volume, since the injected volume is a bijective function of the distance traveled, that is to say, a distance traveled corresponds to a single injected volume.

In a variant, the actuator 85 compares the total injected volume to the predetermined volume by determining whether the piston 80 has reached a predetermined position corresponding to the predetermined volume.

The predetermined position is, in particular, a position such that the movement of the piston from the primary position to the secondary position decreases the volume of the chamber 100 by a volume value equal to the predetermined volume.

The injector 21 is further configured to stop the injection when the injected volume is equal to a predetermined volume.

For example, if the piston 80 has not reached the predetermined position, the actuator 85 continues to move the piston 80 toward the secondary position.

If the piston 80 is in the predetermined position, the actuator 85 stops moving the piston 80.

In a variant, the injector 21 is configured to close the valve 47 when the piston 80 reaches the predetermined position. It should be noted that other types of injectors 21 can be used in the fifth example.

For example, the injector 21 includes a source of second fluid and a flowmeter.

The source of second fluid is, for example, a second fluid reserve under a pressure greater than or equal to the third pressure value, or a pump capable of generating a second fluid stream, such as a gear-type pump or a peristaltic pump.

The injector 21, for example, includes a pressure sensor located, in particular, in the outlet pipe of the source of second fluid, and capable of measuring the pressure of the second fluid leaving the source.

The flowmeter is capable of measuring values of the flow rate of second fluid injected by the injector 21 in the circuit 16.

The flow rate is, for example, a volume flow rate. In a variant, the flow rate is a mass flow rate.

The injector 21 is configured to estimate, from measured flow rate values, the total volume of second fluid injected into the circuit from the flow rate of the injection step. For example, the injector 21 estimates the total injected volume by temporal integration of the measured flow rate values.

The injector 21 interrupts the injection when the total volume is equal to the predetermined volume. For example, the injector 21 closes the valves 47, 105, 110, 115 connecting the injector 21 to the circuit 16.

The injection step is, for example, implemented during a circulation step as previously defined. In this case, the scraper 20 circulates from upstream to downstream in the circulation pipe 15 under the effect of the injected second fluid.

In a variant or additionally, the injection step is implemented during the return step to propel the scraper 20 from downstream to upstream.

The fifth example installation 10 is, in particular, capable of implementing the spraying method previously described, as well as other spraying methods.

For example, the fifth example installation 10 is capable of implementing a spraying method in which, during the circulation step, no scraper 20 is present in the pipe 15. In this case, during the circulation step, the second fluid pushes the first fluid F back in front of it up to the spraying member 13.

According to other possible variants, the injection step is implemented during a method for cleaning at least one from among the color-changing unit 11, the pump 12 and the spraying member 13.

The use of an injector 21 capable of stopping the injection of the second fluid when the injected volume of second fluid is equal to a predetermined volume allows precise control of the quantity of second fluid used during the injection step. In particular, this volume does not depend on the viscosity of the first fluid F (or the mixing between the first fluid F and the second fluid) present in the circuit 16; on the contrary, methods of the state of the art in which a source of second fluid is connected to the circuit 16 during a predetermined time, since the viscosity of the fluid(s) contained in the circuit depends inter alia on the ratio between the first fluid F and the second fluid present in the circuit 16.

This is particularly interesting during a circulation step comprising the spraying of the first fluid F pushed back by the scraper 20 or by the second fluid, since the sprayed volume of first fluid F is then well controlled.

The use of a piston 80 to inject the second fluid into the circulation pipe 15, in particular, allows more precise control of the injected volume of second fluid, in particular, when this fluid is a liquid such as a solvent, than allowed by the injectors 21 of the state of the art. The injectors of the state of the art that use pumps such as gear-type pumps have a flow rate that may vary as a function of the average viscosity. For example, gear-type pumps have internal leaks that depend on this viscosity. As a result, the volume of liquid actually injected into the circulation pipe by the injectors of the state of the art is not effectively controlled. On the contrary, the piston 80, through its movement, makes it possible to impose a volume of propulsion liquid actually injected, since this volume depends solely on the volume variation of the chamber 100. The fifth example installation 10 therefore allows better control of the injected quantity of second fluid.

The estimate of the injected volume of second fluid from the distance traveled by the piston 80 is a method allowing a precise and simple estimate of the injected volume quantity without an apparatus other than the cylinder 75, the piston 80 and the actuator 85 being necessary.

Injectors 21 estimating the volume of second fluid actually injected from measured flow rate values also allow better control of the injected quantity of second fluid.

The injection of the second fluid with a pressure greater than or equal to the pressure of the gas makes it possible to use the gas to propel the second fluid, and therefore reduces the quantity of second fluid necessary.

The estimate of this pressure from the electric current consumed makes it possible to eliminate the need for a sensor, and therefore to simplify the installation 10.

The invention corresponds to any technically possible combination of the embodiments described above.

The invention claimed is:

1. An installation for spraying a fluid, comprising a fluid circulation circuit comprising:

a sprayer capable of spraying the fluid;

a pump and a circulation pipe for the fluid, the pump being suitable for injecting the fluid into the circulation pipe, the circulation pipe being configured to guide the fluid from the pump to said sprayer; and at least one injector configured to inject a liquid separate from the fluid into the circuit, wherein each of the at least one injector is configured to measure at least one value of a volume flow rate for the liquid injected by the injector into the circuit, to estimate a total volume of liquid injected by the injector from the measured flow rate value(s), to compare the estimated total volume of liquid injected by the injector into the circuit to a respective predetermined volume, and to stop the injection when the estimated total volume of injected liquid is equal to the predetermined volume.

2. The installation according to claim 1, wherein each of the at least one injector comprises:

a cylinder capable of containing the liquid;

a piston received in said cylinder; and an actuator capable of moving said piston in said cylinder from a first position to a second position, the injector being configured so that the movement of said piston in said cylinder to its second position causes injection of the liquid in said circulation pipe.

3. The installation according to claim 2, wherein each of the at least one injector is capable of determining a position of said piston in said cylinder and estimating the total volume of liquid injected from at least the determined position.

4. The installation according to claim 1, wherein each of the at least one injector is further configured to inject, into the circuit, a gas capable of propelling the liquid, and to inject the liquid with a first pressure and to inject the gas with a second pressure, the first pressure being greater than or equal to the second pressure.

5. The installation according to claim 4, further comprising a pressure sensor capable of measuring the first pressure.

6. The installation according to claim 4, wherein each of the at least one injector comprises:

a cylinder capable of containing the liquid;

a piston received in said cylinder; and an actuator capable of moving said piston in said cylinder from a first position to a second position, the injector being configured so that the movement of said piston in said cylinder to its second position causes injection of the liquid in said circulation pipe, the actuator comprising an electric motor, the actuator being capable of estimating the first pressure from at least one value of an electric current consumed by said electric motor.

7. The installation according to claim 1, wherein an upstream direction and downstream direction are defined for said circulation pipe, the fluid circulating from upstream to downstream when the fluid is guided by said circulation pipe from said pump to said sprayer, said wherein said injector is configured to inject the liquid in an upstream end of said circulation pipe.

8. The installation according to claim 1, wherein the circuit further comprises a color-changing unit capable of supplying said pump with a plurality of distinct fluids, in which:

each of the at least one injector is configured to inject the liquid into said color-changing unit; and/or each of the at least one injector is configured to inject the liquid into said pump; and/or each of the at least one injector is configured to inject the liquid into said sprayer, said sprayer comprising a rotary bowl and being capable of guiding the liquid to said rotary bowl.

* * * * *